US006645391B2

(12) United States Patent
Greiner et al.

(10) Patent No.: US 6,645,391 B2
(45) Date of Patent: Nov. 11, 2003

(54) VISIBILITY ENHANCEMENT COMPOSITION

(75) Inventors: Michael T. Greiner, Peachtree City, GA (US); Thomas G. LeGare, III, Fayetteville, GA (US)

(73) Assignee: Hazard Control Technologies, Fayetteville, GA (US)

( * ) Notice: Subject to any disclaimer, the term of this patent is extended or adjusted under 35 U.S.C. 154(b) by 0 days.

(21) Appl. No.: 10/151,480

(22) Filed: May 20, 2002

(65) Prior Publication Data

US 2003/0010508 A1 Jan. 16, 2003

Related U.S. Application Data

(62) Division of application No. 09/903,981, filed on Jul. 13, 2001, now abandoned.

(51) Int. Cl.[7] ..... A62D 1/04; A62C 8/00; A62C 35/00

(52) U.S. Cl. ..... 252/8.05; 252/2; 252/3; 169/44

(58) Field of Search ..... 252/2, 3, 8, 8.05; 169/4, 7, 46, 45, 44; 250/573, 574; 510/365, 382

(56) References Cited

U.S. PATENT DOCUMENTS

| | | | | |
|---|---|---|---|---|
| 3,621,917 A | | 11/1971 | Roger et al. | |
| 4,168,239 A | | 9/1979 | Mertz et al. | 252/2 |
| 4,923,903 A | | 5/1990 | Alm et al. | 521/65 |
| 5,585,028 A | * | 12/1996 | Berger | 252/2 |
| 5,676,876 A | * | 10/1997 | Winkler, III | 252/3 |
| 5,945,026 A | | 8/1999 | Thames | 252/8.05 |
| 5,990,486 A | | 11/1999 | Chen et al. | 250/573 |
| 6,065,545 A | | 5/2000 | Williams | 169/47 |
| 6,139,775 A | | 10/2000 | Thames | 210/365 |

* cited by examiner

*Primary Examiner*—Joseph D. Anthony
(74) *Attorney, Agent, or Firm*—McHale & Slavin, P.A.

(57) ABSTRACT

The invention is directed toward biodegradable, non-toxic firefighting concentrate compositions including a fluorescent type compound for foam visualization within the visible and ultraviolet light spectrum and a process for its use.

11 Claims, No Drawings

VISIBILITY ENHANCEMENT COMPOSITION

CROSS-REFERENCE TO RELATED APPLICATION

This application is a divisional of Ser. No. 09/903,981, filed Jul. 13, 2001 now abandoned.

FIELD OF THE INVENTION

The present invention relates generally to compositions and methods for treating fuel hydrocarbons; more particularly, to the incorporation of a visibility enhancing amount of at least one fluorescent type compound effective to permit visualization or tracing of said composition in low light or no light conditions; and most particularly to compounds for providing an ability to visualize compositions utilized for treating fuel hydrocarbons at levels of light otherwise insufficient for such visualization, and to further determine the authenticity of a particular treating composition.

1. Background of the Invention

It has been established that fire suppression agents can be extremely beneficial in effectively quenching fires of various types and eliminating their ability to reignite (U.S. Pat. Nos. 5,945,026 and 6,139,775 to Thames.) According to these patents, a particularly disclosed class of compositions are shown to be useful for application to either surface or subsurface concentrations of hazardous or undesirable hydrocarbons, including masses of gasoline, oil and the like that are spilled on land, and which are intentionally or unintentionally disposed of in sewers, exposed to the soil or the air, or the like as the result of an accident of some sort. Chemical breakdown of the dispersed hydrocarbons can be accelerated by increasing the concentration of available bacteria for this purpose. In some cases, the surface active agent ("surfactant") composition itself can serve as a nutrient for the bacteria, thus enhancing its action in degrading the hydrocarbon materials.

In the past, the concept of utilizing surface active agents in water for treating fires has often been suggested. One aspect of the use of surfactants in firefighting is that such treatment can render the water "wetter," i.e., better able to penetrate into and through the surfaces of semi-solid materials. Moreover, the ability of surfactant materials to create frothing or foaming has been used in an attempt to provide a barrier at the liquid-air interface, which barrier will block oxygen from access to vapor at the liquid surface, usually the surface of a mass of burning oil or gasoline. In this connection, it is well known that, particularly in a petroleum-based fire, the combustion occurs only in the vapor phase, wherein oxygen in large quantities is readily available to the vapors originating within the liquid. In a fire, the increase in temperature accelerates the liquid vaporation and hence the rate of combustion. In many instances, surface active agents, particularly when accompanied by agitation, serve to achieve a mix of liquid water and fuel, thus rendering the fuel less volatile and less susceptible to burning.

However, when combining an agent with the turbulent stream of firefighting water under high pressure, there are limited ways to ensure the adequate coverage of a fire suppressing agent, particularly in conditions where the amount of ambient light is limited. In addition, there are no practical methods available to ensure the authenticity of a stored agent, nor are these effective means for quantifying variable constituents.

2. Description of the Prior Art

U.S. Pat. Nos. 5,945,026 and 6,139,775 issued to Thames relate to a biodegradable, non-toxic firefighting concentrate composition diluted with water and effective when mixed with foam-forming materials. The concentrate is extremely useful in aquatic and land fires. Although the composition in U.S. Pat. No. 5,945,026 does incorporate a dye for visualizing and detecting the coverage of a firefighting agent when combined with other firefighting means, it is effective merely for identification purposes when viewed in sufficient ambient light. There is no suggestion to utilize a fluorescent dye for any purpose whatsoever.

U.S. Pat. No. 6,065,545 to Williams teaches a method and composition for extinguishing fires. The composition involves the use of a visual coloration added to a firefighting agent to detect its presence in ambient light when thrown in a fluid stream comprising fluid and/or foam. However, there is no suggestion disclosed for incorporating the use of a fluorescent dye as a means of visualization other than in lighting conditions sufficient to be easily viewed within the stream of fluid or foam.

U.S. Pat. No. 5,990,486 issued to Chen et al. teaches an apparatus and method for measuring components of a solute stream. The method is accomplished by measuring a concentration of an indicator agent comprising a water soluble or water insoluble dye, specifically claiming rubrene, rhodamine B, or fluorescein or a salt thereof. The solute stream may contain an aqueous film-forming foam. One advantage suggested is that the indicator agents provide greatly increased visibility for the fluid streams in which they are introduced, e.g., enhanced visibility of fire hose stream water or nighttime or other dark situation firefighting applications. Light capable of detecting the indicator agent, e.g., incandescent or ultraviolet (UV) light, can illuminate the liquid at a predetermined reference point. Chen et al. discloses the addition of a fluorescent dye to a stream containing a firefighting additive, e.g., a stream emanating from a fire hose nozzle. The dye is incorporated as a means of for aiding in quantifying the total concentration of the solute, or firefighting agent, and as a means of enhancing visibility of the liquid stream.

There are a multitude of instances when extremely low levels of ambient light make it difficult or impossible to visualize firefighting materials, particularly when the concentration is substantially reduced by foaming of the composition. Low-level light situations include examples such as a fire within a structure without exposure to natural light (i.e. the hull of a ship), a forest fire at night, or any type of situation where the coverage of active agent must be ascertained in the dark.

SUMMARY OF THE INVENTION

The present invention is directed to the incorporation of fluorescent type compounds that are useful for providing increased visualization of fire suppression agents when used to fight fires at levels of light insufficient to enable visualization of a fire suppressant agent, to provide tracing capability to a bio-remediation project, or as a quick reference for security purposes to determine if the product is genuine or counterfeit.

Fluorescent dyes are commonly employed to impart both visible color and fluorescence to other materials to enhance visualization, for example, imaging agents, leak detection, detecting impurities, and the like. Types of dyes typically utilized for visual enhancement are fluoresceins, multi-fluoresceins, rhodamines, pyrenes, etc. Inclusion of such dyes provides a useful addition to methods and compositions of firefighting agents.

High visibility fluorescent dyes that are fluorescent in the visible (400–700 nanometers) spectrum and ultraviolet compounds/dyes, active in the 200–400 nanometer wavelength spectrum, can be used for these purposes. Physical requirements of these compounds include a need to be infinitely dispersible, soluble, or miscible in a water-based system. Although not wishing to be limited to a particular dye, examples of those useful in the present invention are monoazo dyes, such as monoazo xanthene, monoazo anthraquinone, monoazo stilbene, and combinations thereof.

An ultraviolet dye or compound that is active in the 200 to 400 nanometer range can be added in trace amounts to firefighting formulations such that the compound itself is invisible to the unaided eye but exhibits a strong absorbance at specific wavelengths in the Ultraviolet spectrum. Such compounds can be seen on an Ultraviolet/Visible Spectrophotometer as a very sharp peak of absorbance at a very specific wavelength.

Accordingly, it is an objective of the invention to provide a foam composition exhibiting an enhanced degree of visibility.

Another objective of the invention is to provide a composition including at least one fluorescent type compound which enhances visibility while not impairing the functionality of the end product.

A further objective of the invention is to provide a fluorescent type compound useful as an aid for security purposes to determine the authenticity of the product, e.g., a firefighting product.

Yet another object of the invention is to provide a composition for use in a bio-remediation project including a fluorescent type compound with tracing capability.

Another object of the invention is to provide a fluorescent type compound which is biodegradable and non-toxic.

DESCRIPTION OF THE PREFERRED EMBODIMENTS

A variety of different fluorescent dyes having specific visibility in particular ranges within the visible spectrum are described herein. The following examples are illustrative, but not limiting in showing several uses.

One embodiment includes a blend comprised of 3 to 50 parts of a 5 mole ethylene oxide (EO) $C_{16}$–$C_{18}$ tertiary tallow amine, a quantity of carboxylic acid necessary to neutralize the tertiary amine to a pH range of from about 6.0 to about 8.0 (typically 4–20 parts), from about 3 to about 20 parts of a $C_6$–$C_{18}$ linear alcohol (or ethoxylated alcohol), a fluorescent type compound 1500 parts per million of monoazo xanthene, with the remainder being water, such that 100 parts are present in the entire composition, wherein the blend imparts a deep fluorescent yellow/green color that is highly reflective in the visible (400–700 nanometer) spectrum. Additions of these types of compounds/dyes to firefighting and bio-remediation products, e.g. any and all of the formulations referenced in U.S. Pat. Nos. 5,945,026 and 6,139,775, has a high positive visibility effect without impairing the functionality of the end product. A foam producing agent, such as sodium lauryl sulfate, can also be added. In addition, the linear alcohols can be replaced with any $C_6$–$C_{12}$ glycol ether with the addition of the sodium lauryl sulfate or other anionic, nonionic, or amphoteric foaming agent.

In a particularly preferred embodiment, the following components are utilized:

35 Parts of a 5 mole EO $C_{16}$–$C_{18}$ Tallow Amine
12 Parts of a $C_6$ Carboxylic Acid (adjusted pH of the tallow amine: 7.23)
3 Parts of a $C_8$–$C_{12}$ Linear Alcohol Blend
150 Parts per Million of Monoazo Xanthene
50 Parts Water
Foaming Agent An ultraviolet dye or compound that is active in the 200 to 400 nanometer range, such that the compound itself is invisible to the unaided eye, allows the manufacturer to incorporate these compounds in the formulations referenced and inferred in, for example, U.S. Pat. Nos. 5,945,026 and 6,139,775, to determine if the product in question is counterfeit or bona fide.

Another embodiment includes a blend consisting of 5 to 45 parts of a 2 mole (EO) $C_{12}$–$C_{14}$ coconut amine; 5 to 45 parts of a 5 mole (EO) $C_{12}$–$C_{14}$ coconut amine; 4 to 20 parts of a $C_6$–$C_9$ carboxylic acid; 1 to 5 parts of a linear alcohol, 150 parts per million of a Ultraviolet compound/dye (200–400 nanometer active) and the balance of water when mixed has a sharp Ultraviolet absorbance as measured on a Hach DR 2000 UV/Vis Spectrophotometer or equivalent spectrophotometer when set at the compounds specific wavelength. The addition of a foaming agent (1–20 Parts of sodium lauryl sulfate) does not hamper the effectiveness of the UV dye as it is generally accepted that in some firefighting incidents, high foam is a desirable characteristic of the products.

In a particularly preferred embodiment, the following components are utilized:

12 Parts of a 2 mole EO $C_{12}$–$C_{14}$ Coco amine
23 Parts of a 5 mole EO $C_{12}$–$C_{14}$ Coco amine
9 Parts of a $C_6$ Carboxylic Acid (adjusted pH of the Coco amines: 7.18)
3 Parts of a 2 mole EO $C_{11}$ Linear Ethoxylated Alcohol
150 Parts per Million of a 200–400 nanometer active Ultraviolet active compound
53 Parts of Water
Foaming Agent In the case of the 200 to 400 nanometer active compound additive, the amount of absorbance is directly proportional to the concentration. The ability of these compounds to be effective in such small quantity and not be readily visible, provides fingerprint utility for the product to insure it as being genuine. Other UV absorbing compounds which have absorbencies at different wavelengths can be used with equal results. These compound additions can be used with all the combinations of tertiary amines; linear, primary, or ethoxylated alcohols; carboxylic acids and others mentioned or found to be known in the art, e.g. as described in U.S. Pat. Nos. 5,945,026 and 6,139,775.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objects and obtain the ends and advantages mentioned, as well as those inherent therein. The compounds, compositions, biologically related compounds, methods, procedures and techniques described herein are presently representative of the preferred embodiments, are intended to be exemplary, and are not intended as limitations on the scope. Changes therein and other uses will occur to those skilled in the art, which are encompassed within the spirit of the invention and are defined by the scope of the appended claims.

Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A method of firefighting comprising:

preparing a biodegradable, non-toxic foamable firefighting concentrate composition comprising, by volume, a mixture of 7 to about 45 parts of a 2 mole (EO) $C_{12}$–$C_{14}$ coconut amine, 7 to 45 parts of a 5 mole EO $C_{12}$–$C_{14}$ coconut amine, a $C_6$ to $C_9$ carboxylic acid in an amount effective to neutralized said tertiary amine to a pH within the range of from about 6.0 to about 8.0, from about 3 to about 20 parts of an alcohol, a compound having fluorescent properties in an amount effective to permit visualization or tracing of said concentrate composition in low light or no light conditions, and the remainder being water, such that 100 parts by volume are present in the entire composition;

Injecting said concentrate composition into an aqueous stream intended for firefighting such that said stream includes said concentrates composition in an amount effective to permit said visualization or tracing;

utilizing said stream to form an aqueous foam effective to provide fire resistance to a target; and directing said foam toward said target;

wherein said foam is visible when exposed to light in the range of from about 200 to about 700 nanometers.

2. The method of claim 1, wherein said quantity of carboxylic acid is from about 4 to about 20 parts by volume.

3. The method of claim 1, wherein said alcohol is at least one alcohol selected from the group consisting of a $C_6$–$C_{18}$ linear alcohol and an ethoxylated alcohol.

4. The method of claim 1, wherein said compound having fluorescent properties reflects in the visible spectrum of about 400 to about 700 nanometers.

5. The method of claim 1, wherein said compound having fluorescent properties reflects in the ultraviolet wavelength range of about 200 to about 400 nanometers.

6. A method according to claim 1, wherein said compound having fluorescent properties is a monoazo xanthene dye.

7. A method according to claim 1, wherein said compound having fluorescent properties is a monoazo anthraquinone dye.

8. A method according to claim 1, wherein said compound having fluorescent properties is a monoazo stilbene dye.

9. A method according to claim 1, which further includes the step of:

adding a foaming agent, said foaming agent being present in the amount of from about 1 to 20 parts, said parts being added before the said balance being water.

10. A compound as defined in claim 9, wherein said foaming agent is sodium lauryl sulfate.

11. A method according to claim 1, wherein said compound having fluorescent properties is at least one composition selected from the group consisting of a monoazo xanthene dye, a monoazo anthraquinone, and a monoazo stilbene.

* * * * *